United States Patent [19]

Woolley

[11] 4,251,086

[45] Feb. 17, 1981

[54] ICE SKATE

[75] Inventor: George C. Woolley, Pointe Claire, Canada

[73] Assignee: M. O. Sales Ltd., Ste-Adele, Canada

[21] Appl. No.: 100,902

[22] Filed: Dec. 6, 1979

Related U.S. Application Data

[63] Continuation of Ser. No. 868,452, Jan. 10, 1978, abandoned.

[51] Int. Cl.[3] ..... A63C 1/30

[52] U.S. Cl. ..... 280/11.12; 264/274; 264/327; 280/11.18

[58] Field of Search ..... 280/11.12, 11.18, 11.17, 280/11.3, 11.19; 264/274, 327, 346, 235, 342

[56] References Cited

U.S. PATENT DOCUMENTS

| | | | |
|---|---|---|---|
| 1,115,790 | 11/1914 | Drevitson | 280/11.17 |
| 3,212,786 | 10/1965 | Florjancic et al. | 280/11.12 |
| 3,671,622 | 6/1972 | Humphries | 264/327 |
| 4,053,168 | 10/1977 | Goverde | 280/11.12 |
| 4,088,335 | 5/1978 | Norton et al. | 280/11.18 |
| 4,175,315 | 11/1979 | Hayes et al. | 264/327 |

FOREIGN PATENT DOCUMENTS

| | | | |
|---|---|---|---|
| 585720 | 10/1951 | Canada | 280/11.17 |

*Primary Examiner*—David M. Mitchell

*Attorney, Agent, or Firm*—Swabey, Mitchell, Houle, Marcoux and Sher

[57] ABSTRACT

A unitary molded plastic blade support and metal blade is provided for an ice skate. The support includes an upper portion provided with heel and sole platforms to receive the heel and sole of a boot, and a runner portion embedding and anchoring a metal blade partially exposed. The blade has a central section and adjacent front and rear sections. A plurality of longitudinally spaced-apart anchoring projections are provided at least on the front and rear sections of the blade and integral with the blade. The keying projections extend inwardly towards the central section to form anchoring hooks engaged in the molded plastic.

2 Claims, 4 Drawing Figures

ICE SKATE

This is a continuation, of application Ser. No. 868,452 filed Jan. 10, 1978 and now abandoned.

BACKGROUND OF THE INVENTION

1. Field of the Invention

This invention relates to improvements in ice skates, and in particular, to the type of skate in which a plastic support is provided for holding the blade.

2. Description of the Prior Art

Until recently, conventional skates included, in the case of hockey skates, a fabricated metal tubular runner connected to the sole and heel of the skate boot by a pair of frusto-conical metal members welded or riveted to the tubular runner, and a skate blade held by a pair of downwardly extending flanges from the tubular runner. In the case of figure skates, the blade is thicker, and the complete blade and support members are an integral stamping.

The construction of the metal tubular blade support requires numerous manual operations, and with today's high cost of labour, the skate is rendered expensive.

In recent years, it has been thought that by molding the support portion, including the runner, out of plastics material and inserting the blade into a slot provided in the plastics support, the manual operations would be reduced considerably, thereby reducing the cost of the skates. Examples of such skates are Canadian Pat. No. 585,720, issued Oct. 27, 1959, Kirkpatrick et al, in which a one-piece molded plastics support with a metal blade keyed in the plastics support, was suggested. The support so formed resembles the typical metal tube type support. The blade was anchored or keyed in the plastics support by a series of T-shaped elements provided on the upper edge of the blade and provided with intervening plastics receiving openings which were filled with plastic during the molding operation.

It has been found that a serious disadvantage exists in this method and structure for securing the blades to the plastic body. It has been found that the T-shaped anchors which are subject to severe impact forces cannot be effectively and securely molded into the plastic. The reason for this is believed to be based on the inherent behaviour of plastic which is cast hot and which shrinks when it cools. This shrinking thereby allows for the possibility of gaps around the T-shaped keys necessarily resulting in a weakened support.

Canadian Pat. No. 697,856, Florjancic et al, issued Nov. 17, 1964, describes a plastic support with a stamped blade having upward and side projections as well as apertures so that when the plastic material is molded on the blade, the blade will be properly anchored within the support. Furthermore, a reinforcing bar 24 is required in the plastic material to give the support proper strength.

Canadian Pat. No. 985,322, Tvengsberg, issued Mar. 9, 1976, shows a further version of a skate molded-support which has a plurality of openings in the skate blade such that the molded plastic material will pass through the openings and be integrally molded with the blade.

All of the above patents which show a molded support and a blade connected by means of openings or projections in the blade have an inherent failure in that most suitable plastic material must be heated to 500° F. so that it can flow through a suitable injection orifice to be molded on the blade and to pass through openings or lugs provided on the blade. However, the plastic contracts considerably when cooled. The skate blade, being made of steel, has a much lower rate of contraction when it is cooled and, therefore, the plastic material, when contracting, leaves considerable openings or gaps about the various lugs or openings provided in the skate blade to be keyed or anchored in the plastics material. Thus, the reduced anchoring or keying of the metal lugs of the blade, such as T lugs or strictly square or rectangular outline lugs, or the openings in the Tvengsberg patent, have little remaining plastics material surrounding them.

SUMMARY OF THE INVENTION

It is an aim of the present invention to provide an improved skate blade and plastic support molded thereon, whereby the anchoring projections effectively anchor the blade to the plastic material after cooling of the molded plastic material, thereby overcoming the disadvantages of the prior art skates.

A construction in accordance with the present invention includes a plastic support member for an ice skate, the support member including an upper portion provided with heel and sole platform means to receive the heel and sole of the skate boot, a lower portion including a runner embedding and anchoring a metal blade partially exposed from the runner; the blade having a central section and adjacent front and rear sections, at least the front and rear sections being provided with a plurality of longitudinal, spaced-apart, anchoring projections integral with the blade and extending inwardly towards the central section so as to form anchoring hooks engaging in the molded plastic.

In a more specific embodiment of the present invention, each of the keying projections forming the anchoring hooks, has a sloped back edge extending at an angle inwardly towards the central section such that when the molded plastic material of the support member contracts and flows while cooling, it will merely press the blade downwards slightly by action of the flow of material along the sloped outer edges of the projection.

A method in accordance with the present invention includes providing a mold, locating a blade with a central section and front and rear sections in the mold with the blade having inwardly directed hook-like projections, injecting hot thermoplastic material into the mold such that it flows about the top area of the skate blade and around the inwardly extending hook projection with sloped back edges, cooling the central section of the mold adjacent the central section of the blade while maintaining a higher temperature at the front and rear sections of the blade and mold such that the central section of the plastic material will cool faster than the outer section, thereby directing the contraction of the plastics material towards the central section as the front and rear sections are cooled to slightly press down on the back edges of the hook-like projection, embedding the hook portions of the projection firmly in the plastics material.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
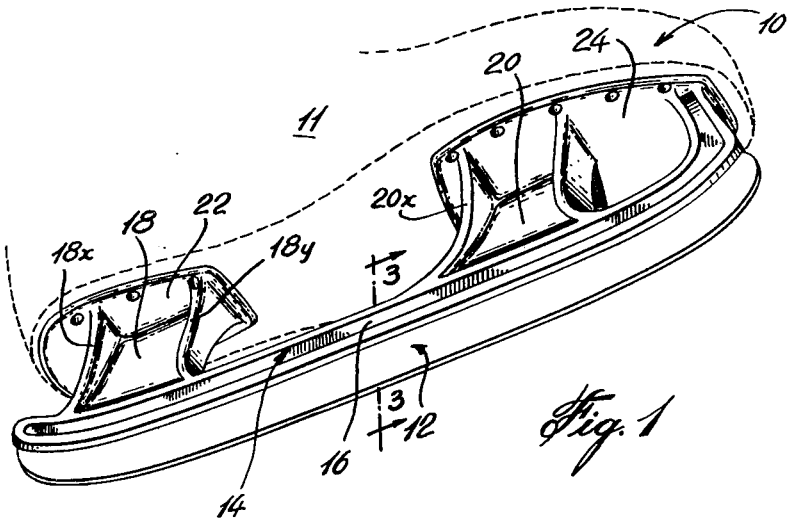
FIG. 1 is a perspective view of a skate blade and a blade support in accordance with the present invention.

Referring now to the drawings, there is shown a skate 10 having a boot 11, and a metal blade 12 embedded in a blade support member 14.

The blade support member 14 includes a runner portion 16 having, in the present embodiment, an outwardly facing channel configuration on either side of the blade 12 providing rigidity to the structure of the runner 16. A pair of pedestals 18 and 20 merge with the top of the runner 16, and each pedestal 18 and 20 has, in this embodiment, ribs 18*x*, 18*y* and 20*x*, 20*y*, providing an H-cross-section for structural rigidity. Mounted on each respective pedestal 18 and 20 are flat platform members 22 and 24 adapted to receive the heel and sole respectively of the skate boot 11. The boot 11 would be normally conventionally riveted to the platform but could be attached by other means.

Figure 4:
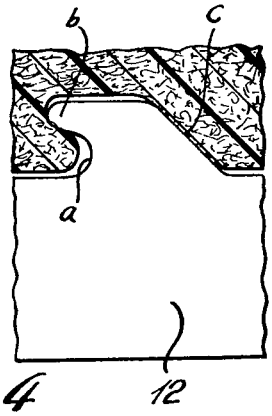
FIG. 4 is an enlarged fragmentary view of the support.

The support member 14 is normally injection molded in one piece, embedding the top portion of the blade 12. The top edge 26 of the blade 12 is provided with spaced-apart anchoring projections 28, 30 and 32. Only three projections are shown in the present embodiment; however, it is understood that fewer or more projections could be used. Each of the projections as shown in FIG. 4, for instance, is in the shape of a hook having a bight portion a, a head portion b extending over the bight, and a sloped back edge c. The head b of each of the anchor projections 28, 30 and 32 is directed inwardly towards the center of the blade, as will be described in more detail later. The head b overhangs the bight portion a in each case, and as mentioned before, projects towards the center of the blade forming a hook. The head b can have a greater overhang if necessary, depending on the actual contraction movement of the plastic when it is cooling.

The blade 12 is also provided with a rounded front end 34 which extends above the top edge 26 of the blade, and a rear portion 36 which also extends above the top edge 26 and has a slight overhang inwardly.

Figure 2:
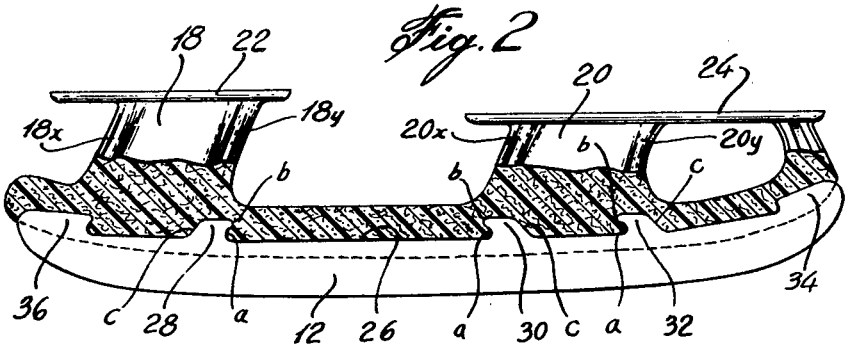
FIG. 2 is a side elevation of the skate showing the blade in elevation and the runner in cross-section.
Figure 3:
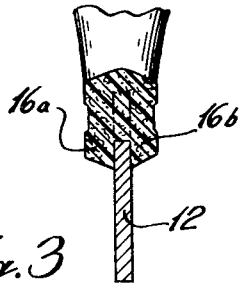
FIG. 3 is a vertical cross-section taken along line 3—3 of FIG. 1.

As shown in FIGS. 2 and 3, the runner 16 is molded onto the top portion of the blade such that the anchor projections 28, 30 and 32 as well as the front portion 34 and rear portion 36, are well embedded in the plastics material. A portion of the blade is also embedded to the extent of about 0.160". In a typical example, 0.665" of the blade is exposed. As shown in FIG. 3, the final molded product includes flanges 16*a* and 16*b* which project and hold either side of the blade 12.

A typical plastic material which is used for the support 16 is obtained as Bayer 2084 with a fiberglass content of about 60%.

The ends of the runner 16 are made to slightly overhang the rounded ends 36 and 34 so as to prevent accidental dislodging of the blade and also to give added protection against injury. It is also considered important from the structural point of view to locate the anchoring projections 28, 30 and 32 in areas where there are reinforcing ribs, such as reinforcing ribs 18*x*, 20*x* and 20*y*.

In the molding operation, the blade 12 is inserted in a lower part of the mold. The plastic material is injected into the mold at relatively high temperatures, that is, in the range of 500° F. The central part of the mold, that is, corresponding to the center area of the blade 12 and the support 16, would be water cooled with the purpose of cooling the temperature of the mold to approximately 50° F. while the ends of the mold would be maintained at approximately 200° F. Thus, as the plastic material in the mold cools, it will contract towards the center since that portion of the support 16 is cooler than the outer front and rear portions of the molded plastic material. As the plastic cools, the flow will be towards the center as it contracts, and thus the flowing material will press slightly on the sloped surfaces c of the anchoring projections 28, 30 and 32, forcing the blade slightly downwardly from the plastic material. At the same time, the plastics material will retract from the bight a, but the overhanging head b, as the blade is pressed down, will press down more into the remaining plastics material in the bight a. Accordingly, once the plastic support 16 has finally cooled, the head b will still be well anchored in the remaining solidified plastic material.

I claim:

1. A method of forming a skate blade and unitary plastic molded support for use with an ice skate, including the steps of providing a mold, locating a metal blade having a central section and front and rear sections with the front and rear sections at least having hook-like projections directed inwardly towards the central section of the blade, injecting hot thermoplastic material into the mold such that it flows about the top area of the skate blade and around the inwardly extending hook projections, cooling the central section of the mold adjacent the central section of the blade while maintaining higher temperatures at the front and rear sections of the blade and mold such that the central section of the plastics material will cool faster than the outer section thereby directing the contraction of the plastics material towards the central section as the front and rear sections are cooled, such that the flow of the plastics material flows around the inwardly directed hook so that the hook will engage in the plastics material after it is cooled.

2. A method as defined in claim 1, wherein the central section of the mold is cooled to 50° F. and the front and rear sections of the mold are maintained at 200° F.

* * * * *